US005674110A

United States Patent [19]

Cuoghi

[11] Patent Number: 5,674,110

[45] Date of Patent: Oct. 7, 1997

[54] MACHINE AND A PROCESS FOR SIZING AND SQUARING SLABS OF MATERIALS SUCH AS A GLASS, STONE AND MARBLE, CERAMIC TILE AND THE LIKE

[75] Inventor: Paolo Cuoghi, Formigine, Italy

[73] Assignee: Onix s.r.l., Formigine, Italy

[21] Appl. No.: 542,162

[22] Filed: Oct. 12, 1995

[30] Foreign Application Priority Data

May 8, 1995 [IT] Italy ..... MO95A1074

[51] Int. Cl.[6] ..... B24B 1/00

[52] U.S. Cl. ..... 451/44; 451/214; 451/194; 451/231; 451/403

[58] Field of Search ..... 451/44, 178, 182, 451/190, 194, 214, 231, 232, 257, 262, 279, 278, 365, 366, 403, 139, 914, 405, 159, 334

[56] References Cited

U.S. PATENT DOCUMENTS

| | | | |
|---|---|---|---|
| 1,402,457 | 1/1922 | Milliken | 451/231 |
| 1,409,208 | 3/1922 | Wieneke | 451/214 |
| 1,650,345 | 11/1927 | Greer | 451/231 |
| 2,148,369 | 2/1939 | Eastwood | 451/231 |
| 2,418,737 | 4/1947 | Talboys | 451/231 |
| 2,603,042 | 7/1952 | Moxley | 451/403 |
| 2,648,174 | 8/1953 | Bikles | 451/194 |
| 2,714,316 | 8/1955 | Ingersoll et al. | 451/403 |
| 4,793,102 | 12/1988 | Dlouhy | 451/44 |
| 5,087,307 | 2/1992 | Nomura et al. | 451/44 |
| 5,097,630 | 3/1992 | Maeda et al. | 451/194 |
| 5,274,959 | 1/1994 | Dyer et al. | 451/178 |

FOREIGN PATENT DOCUMENTS

| | | |
|---|---|---|
| 38548 | 3/1887 | Germany . |
| 646843 | 6/1937 | Germany . |
| 924371 | 2/1955 | Germany . |
| 1826154 | 2/1961 | Germany . |

*Primary Examiner*—James G. Smith
*Assistant Examiner*—Dona C. Edwards
*Attorney, Agent, or Firm*—Browdy and Neimark

[57] ABSTRACT

The machine comprises at least one workpiece-bearing device is provided, upon which a tile or a stack thereof can be placed and blocked. The workpiece-bearing device is revolvable and can be positioned at any angle about a fixed axis. At least one drive head is fitted with at least one rotating grinding wheel, which operates on one side of the tile or on same sides of tiles forming the stack. The workpiece-bearing device and the drive head are constrained to a fixed frame in such a way that a plane of work motion of the at least one grinding wheel is disposed parallel to an axis of rotation of the workpiece-bearing device.

20 Claims, 3 Drawing Sheets

MACHINE AND A PROCESS FOR SIZING AND SQUARING SLABS OF MATERIALS SUCH AS A GLASS, STONE AND MARBLE, CERAMIC TILE AND THE LIKE

BACKGROUND OF THE INVENTION

1. Field of the Invention

The invention relates to a machine and a process for sizing and squaring slabs of various materials.

The invention finds wide application since it is adaptable for sizing and squaring slabs of different kinds of material, such as glass, stone, ceramic material and the like.

Preferably but not exclusively, the invention can be used for sizing and squaring ceramic tiles made of materials, such as porcelain stoneware, that after firing have to be taken on to finishing operations, such as grinding.

2. Description of the Related Art

The prior art teaches sizing and squaring machines for such operations, which are structurally complex and expensive; setting and adjustment is also problematic and complex in these machines, with a resultant qualitative inconsistency in results obtained, especially after prolonged use.

In the above machines, the slab to be sized and squared moves along a line during which it is ground, by a plurality of opposed grinding wheels, on two opposite edges thereof that are parallel to its direction of advancement. The grinding wheels are located in facing and opposite pairs along the line. The distances between the two opposing grinding wheels of each pair are set according to the slab sizing required, the distances therebetween being graduated along the line diminishingly until a final pair thereof achieves a final desired workpiece size.

The workpiece is drawn by a conveyor to which it is pressed by means of rollers or belts (speed-synchronized with the conveyor) acting as pressors.

Prior art realizations characterized by an ability to carry out both sizing and squaring phases are equipped with a first series of grinding wheels, as described above, and thereafter include a rotating device which rotates the piece, usually by 90°. The rotating device is provided with simple means for introducing and transferring the piece to a second sizing unit, almost identical to the first, which sizes the two remaining unground opposite sides.

The above mentioned known machines, apart from being complicated and expensive, are not capable of offering satisfactory results either in terms of sizing or squaring. Furthermore, the said machines require scrupulous and accurate adjustment and setting up, and have to be tried out several times before perfect setting is achieved, and even then there is no guarantee of results of consistent and acceptable quality. For this reason, even in optimal working conditions, it is not possible to obtain a constant sizing regularity, which results in the need to classify and store the tiles according to the different sizes obtained.

SUMMARY OF THE INVENTION

The present invention, as it is characterized in the appended claims, aims to resolve problems in the prior art by providing a machine which comprises:

at least one workpiece-bearing device, onto which a workpiece or a stack thereof can be placed and blocked; said device being revolvable and positionable at various angles about a fixed axis thereof;

at least one drive head fitted with a rotating tool, for the present purpose a grinding wheel, which grinding tool operates on one edge of the workpieces or the stack of workpieces; the drive head bearing the grinding wheel being provided with a back-and-forth movement that is parallel to an axis of the workpiece-bearing device.

One advantage of the present invention is that it is constructionally simple.

A further advantage is represented by its structural configuration which makes it suitable for lengthy and continuous operations in a particularly hostile environment characterized by the presence of fine powders of extremely abrasive materials highly damaging to all kinds of mechanical coupling.

A still further advantage of the present invention is that it can be readily incorporated into a production line.

Yet another advantage of the present invention lies in the simplicity with which it can be adapted to various types of workpiece shapes.

BRIEF DESCRIPTION OF THE DRAWINGS

Further advantages and characteristics of the present invention will emerge from the detailed description that follows, made with reference to the accompanying drawings, which represent some preferred but not exclusive embodiments of the invention, here illustrated in the form of a non-limiting example, in which.

DESCRIPTION OF THE PREFERRED EMBODIMENTS

Figure 1:
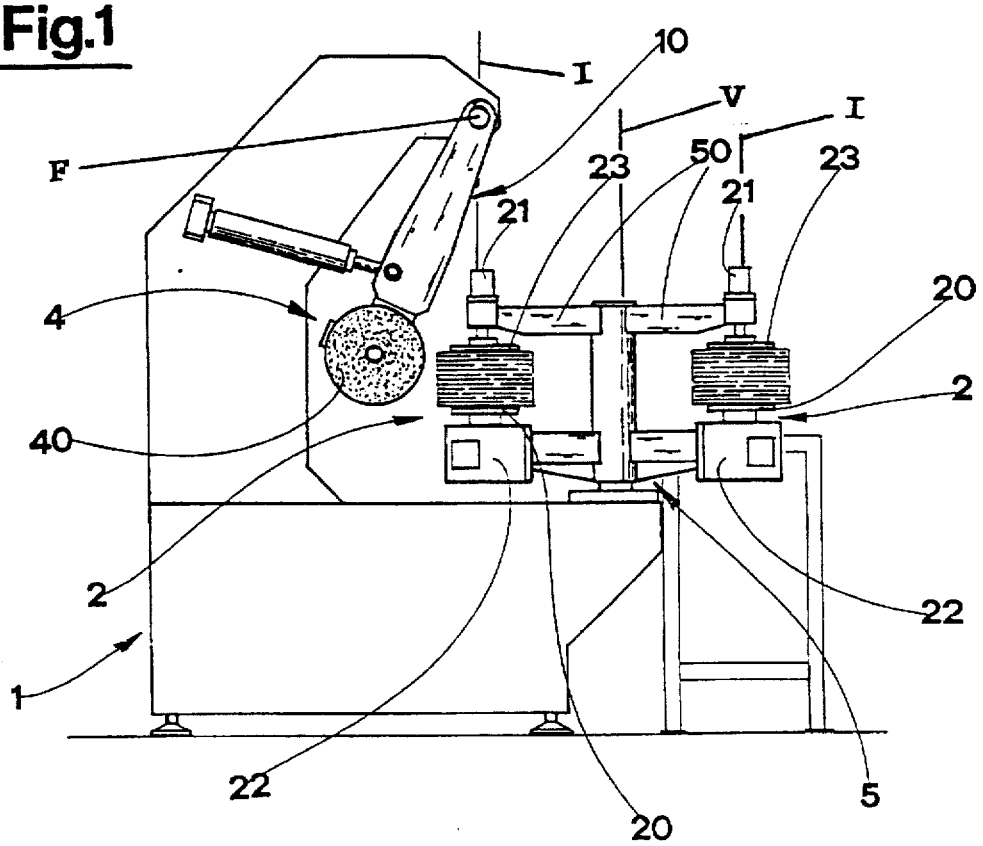
FIG. 1 shows a schematic front view in vertical elevation.

With reference to the drawings, 1 denotes in its entirety a fixed frame 1 to which a rotating platform 5, capable of rotating about a vertical axis, is fixed. This vertical axis is denoted by dash-dot axis line V in the drawing. It is to be distinguished from the index or indexing axis I and the fixed axis F.

On the rotating platform 5 two identical workpiece-bearing devices 2 are located in diametrically opposite positions.

Each workpiece-bearing device 2 comprises a horizontal support surface 20 designed to accommodate a face of a slab, in the present case constituted by a ceramic tile 3. The support surface constitutes the surface on which the tiles or other slabs lie, and hence it's plane is herein referred to as a "lie" plane. Pneumatically activated means for clamping or blocking 21, operating above the support surface 20, are inferiorly equipped with a small plate 23. The means for blocking 21 are preferably constituted by pneumatic cylinders whose cylinder end is solidly fixed to an arm 50 of the platform 5 while the cylinder stem is hinged by an end thereof to the small plate 23 in such a way that the small plate 23 can rotate with respect to the stem.

The small plate 23 is arranged vertically dead (i.e. directly) above the support surface 20 so that a single tile or a stack of tiles can be gripped therebetween.

The support surface 20 is mounted on an indexing device 22 of known type having a function of enabling precise, angularly predetermined rotations to be made about an index axis or indexing axis of the device 20, which is generally vertical in the preferred embodiment illustrated in the drawing.

Figure 2:
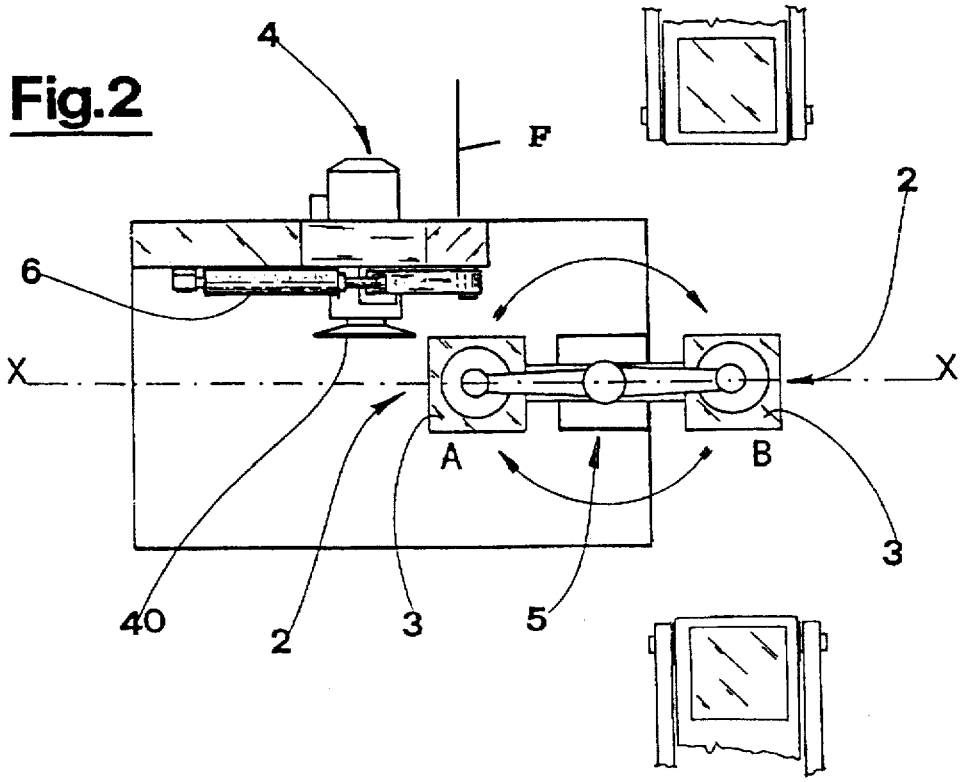
FIG. 2 shows a schematic view from above of FIG. 1.
Figure 3:
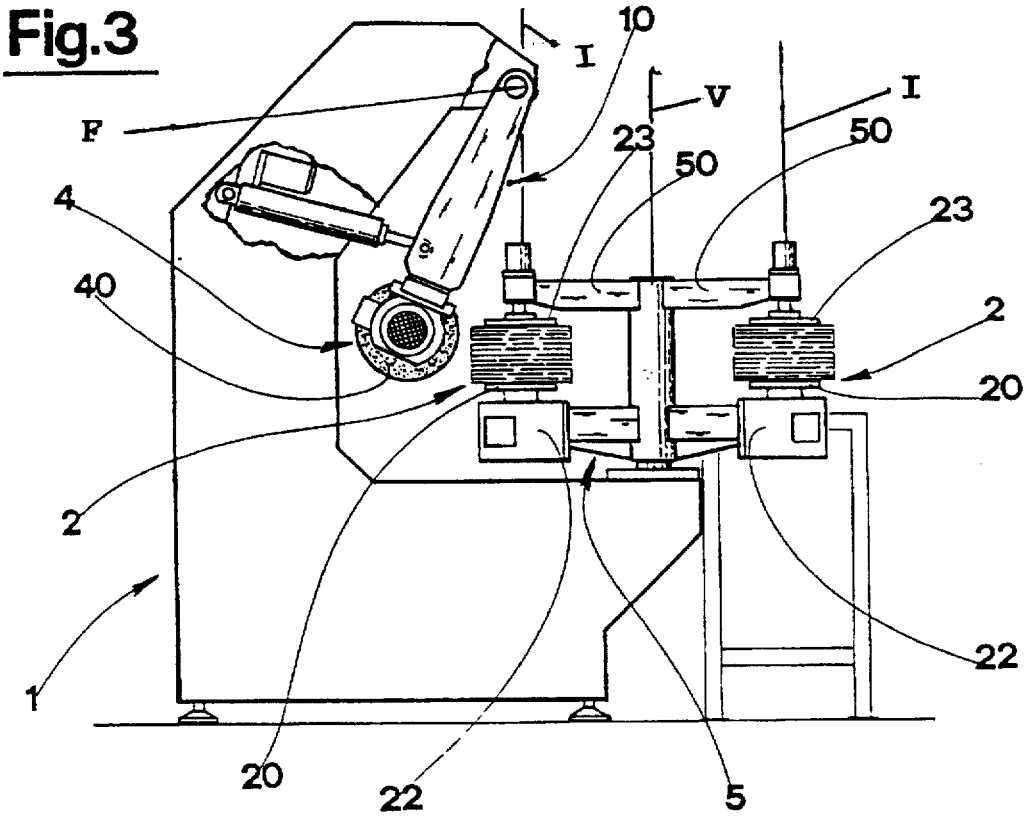
FIG. 3 shows a schematic front view in vertical elevation of a second preferred embodiment of the invention.
Figure 4:
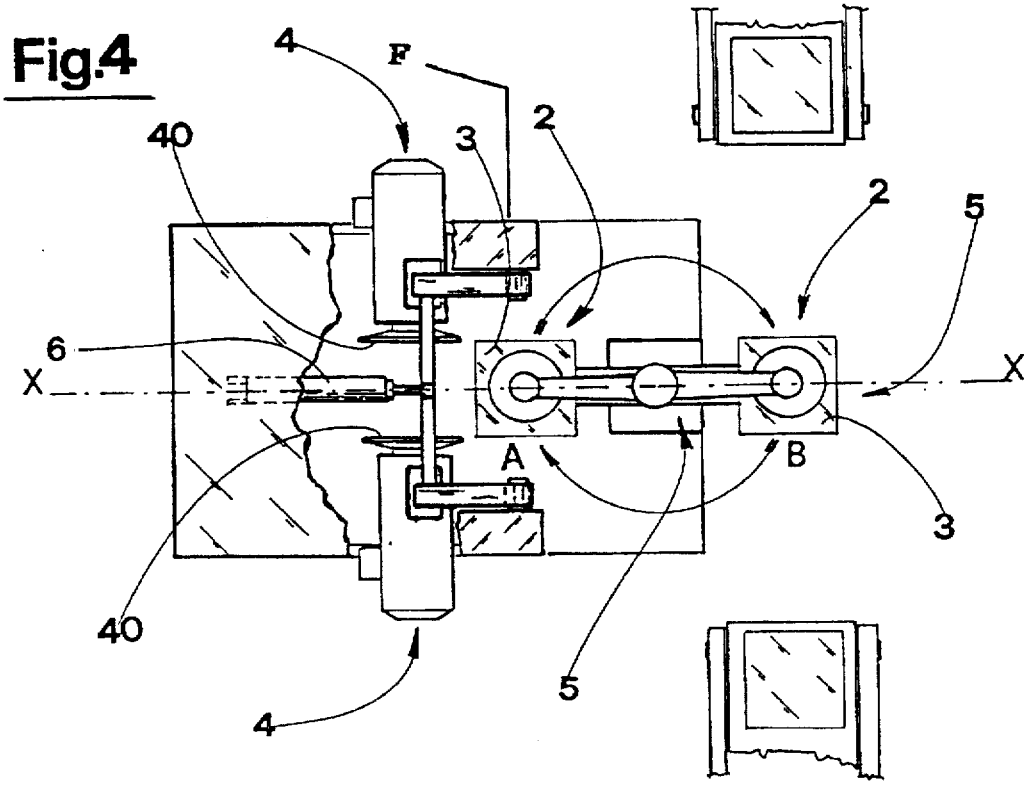
FIG. 4 shows a schematic view from above of FIG. 3.
Figure 5:
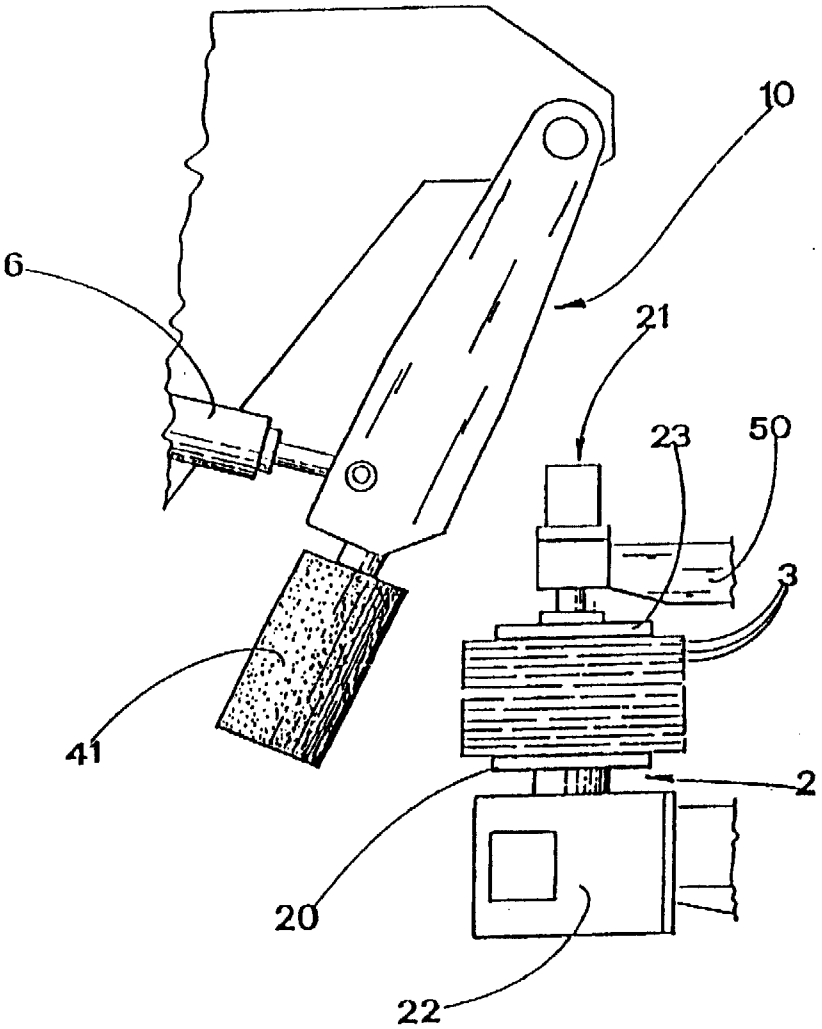
FIG. 5 shows in enlarged scale a part of a front view in vertical elevation of a further embodiment of the invention.
Figure 6:
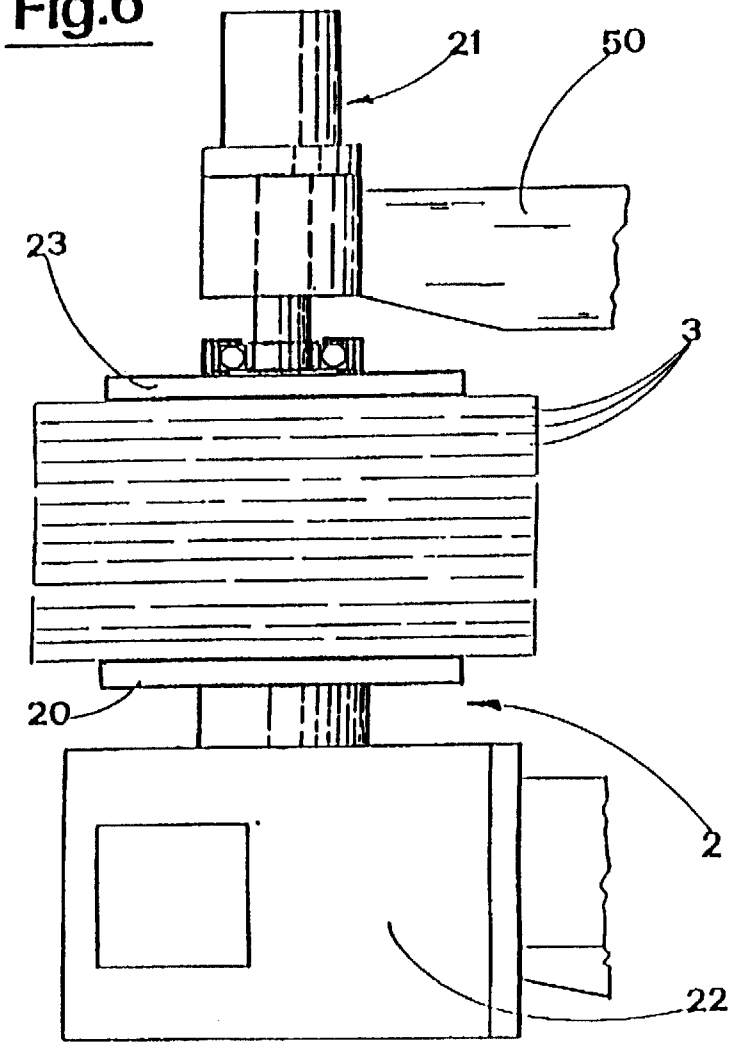
FIG. 6 shows, in enlarged scale, a detail common to the embodiments represented in FIGS. 1, 3, and 5.

The embodiment shown in FIGS. 1 and 2 exhibits a drive head 4 fixed to a mobile frame 10 which is hinged about a horizontal axis thereof to the fixed frame 1, said horizontal axis being also perpendicular to the axis of rotation of the platform 5 and to the axis of each single workpiece-bearing device 2. The drive head 4 is fixed to the mobile frame 10 in such a way that its position can be set in a parallel direction to the axis about which the mobile frame 10 is pivoted to the frame 1. The horizontal axis, since it is located relative to the fixed frame 1, is also herein termed a fixed axis and denoted by the letter F in the drawing.

A cutting tool constituted by a frontal grinding wheel 40 is mounted on the drive head 4. The frontal grinding wheel 40 and the edge-working grinding wheel 41 discussed below, both of which are herein denoted by the term "grinding wheel", are so-called because of where they abrade. The frontally-acting wheel 40 abrades on its front surface while peripherally-acting wheel 41 grinds with its peripheral edge, where the terms "front" and "periphery" are defined relative to the spin axis of the grinding wheel. Because of its position, the frontal grinding wheel 40 operates along a vertical plane which is parallel to the axes of rotation of the workpiece-bearing devices 2. The advancing motion towards the drive head 4 and consequently to the grinding wheel 40 is caused by a double acting cylinder 6 connecting the mobile frame 10 to the fixed frame 1.

The platform 5 can also be set in predetermined positions and can rotate through 180° so as to alternatively place the workpiece-bearing devices into the positions indicated in the figures by the letters A and B. Position A represents the working position whilst position B represents the loading and unloading position.

The drive head 4 is mounted on the mobile frame 10 in such a way as to enable adjustment of the drive head position in a perpendicular direction to median line X—X containing both axes of the rotating platform 5 as well as the axes of rotation of each workpiece-bearing device 2 when the latter are in positions A and B.

The setting of the drive head 4 position and thus the distance between the frontal grinding wheel 40 and line X—X makes it possible to carry out the tile sizing operation to the specifications desired. According to the operative working cycle of the machine, a single tile 3 or—more frequently—a stack of tiles is placed onto a workpiece-bearing device 2 in position B. Means for positioning, not shown in the accompanying drawings, enable the positioning of a stack of tiles 3 so that two opposite sides thereof are parallel to line X—X.

The stack of tiles 3 is held fast on the workpiece-bearing structure 2 through use of means for gripping 21 which operate on the stack of tiles by means of the small plate 23.

The workpiece-bearing device 2 loaded with the stack of tiles 3 can be moved from position B to position A by a rotation of 180°. After the said rotation the two opposite edges of the tiles 3 in the stack are still parallel to line X—X. The platform 5 is now blocked. The drive head 4 can be moved forward by action of the cylinder 6 which causes the grinding wheel 40 to interact with one edge of all the tiles 3 in the stack placed on the same side, and consequently one side of the stack of tiles 3 on the workpiece-bearing device 2 is levelled off.

Once the levelling off of one side of the tiles has been carried out and the grinding wheel has returned to a position of non-interference with the stack, the stack can be rotated by 90° or 180° using the indexing device 22 to bring adjacent or opposite sides of the tiles 3 into a workable position. By repeating this operation of the frontal grinding wheel 40 on the sides of the tiles 3, the sizing operation thereon is complete in one direction. The size of the tiles when completely levelled off is twice the distance between the frontal grinding wheel 40 and line X—X.

The same operation can be repeated for the remaining two sides of the stack of tiles 3 to complete the sizing operation. The use of the indexing head 22 allows for precise angular positioning of the stack of tiles 3 which are tightly gripped on the workpiece-bearing device 2. Thanks to the use of the indexing head 22, the sizing and squaring of the stack of tiles 3 are carried out simultaneously.

Once the operation has been completed, the platform rotates by 180° and carries the stack of finished tiles to position B, and a new stack of tiles to be worked into position A.

Obviously, it is also possible to size and square non-square tiles, such as rectangular-shaped ones, by adjusting the distance between the drive head 4 and line X—X.

In the second embodiment, two opposite drive heads 4 are mounted on the mobile frame 10 by adjustable couplings. In this case, the size which will obtain is represented by the distance between the two opposite grinding wheels 40 keyed on the two drive heads 4.

Compared to the first embodiment, the second offers the possibility of working simultaneously on two opposite sides of the stack of tiles 3 tightly blocked on the workpiece-bearing device 2. Once a pair of opposite sides have been worked, it is sufficient to rotate the workpiece-bearing device 2 by 90° in order to size the remaining two sides of the tiles 3.

Here too, the sizing and squaring operations are carried out rapidly and efficiently thanks to the structure of the machine incorporating the indexing head 22.

Exact sizing of the stack of tiles 3 is made possible by the fact that it is the same pair of opposite grinding wheels 40, mounted on the drive heads 4 which are both fixed on the same frame 10, that operate on opposite sides of the stack of tiles 3.

To check that sizing is constantly accurate, it is sufficient periodically to check the distance between the two opposite grinding wheels 40 and to adjust the position of the heads 4 accordingly.

A third embodiment differs from the second in that it is equipped with drive heads on which edge-working grinding wheels 41 are mounted.

Naturally, in this case the axis of rotation of the grinding wheels 41 has to be situated in a plane parallel to that of line X—X.

The machine described, in all the above-described second and third preferred embodiments, is structured in such a way as to permit sizing and squaring of tiles. To sum up, the machine carries out the following operations:

- positioning and blocking of at least one tile 3 on a workpiece-bearing device 2 which can be precisely positioned at any angle about an axis thereof;
- working of one side of a tile 3 by means of rotating grinding wheels 40, 41 positioned opposite each other at a predetermined distance one from another and operating on a plane which is parallel to the axis of rotation of the said workpiece-bearing device 2;
- rotation of the workpiece-bearing device 2 through a predetermined angle and its blocking in said position;

working of other edges of the tile 3 by means of grinding wheels 40 and 41 operating on planes which are parallel to the axis of rotation of the workpiece-bearing device 2.

To square the tiles 3, the angle of rotation of the workpiece-bearing device 2 between one work phase and a next is 90°.

The workpiece-bearing device 2 is so shaped and realized as to permit positioning and gripping of an orderly stack of matching tiles.

A further embodiment of the invention includes a change in the location of the drive heads on which the tools are mounted and consequently, a change in the reciprocal location of the platform carrying the workpiece-bearing devices. In this embodiment, the drive heads are stationary with respect to the frame while the forward movement is transmitted to the platform or to each single workpiece-bearing device which in turn are set in motion along suitably arranged slideways.

With this invention it is possible to carry out the sizing and squaring of the tiles with geometrical precision thanks to the possibility of working the stacked tiles simultaneously. A further consequence is an increase in production speed. For this reason, the present invention can be easily incorporated into a tile production line.

A further advantage of the invention is its versatility thanks to which the machine can be used to work tiles or other slabs which are neither square nor rectangular. From the structure disclosed above, it follows that the invention can made tiles or slabs which are polygonal: for example, triangular, sexagonal, or hexagonal.

Yet another advantage of the invention is its structural resistance to wear on mechanical couplings and components which is due to the presence of very fine particles of very hard materials which develop during the working of the machine.

What is claimed is:

1. A machine for sizing and squaring slabs of materials such as glass, stone and marble, ceramic tiles, the machine comprising:

a fixed frame;

at least one workpiece-bearing device onto which at least one tile can be placed and held fast;

said at least one workpiece-bearing device being revolvable and precisely positionable about at least one index axis thereof at various angles with respect to said fixed frame;

at least one drive head bearing at least one rotating grinding wheel destined to work on at least one side of said at least one tile; said at least one workpiece-bearing device and said at least one drive head being constrained to said fixed frame in such a way as to enable a relative motion thereof in at least one side plane which is not parallel to a lie plane of said at least one tile.

2. The machine of claim 1, wherein said at least one workpiece-bearing device comprises a support surface on which a face of said tile can be placed; above said support surface operate means for blocking which upon being activated press said at least one tile against the support surface such that said at least one tile is held fast therebetween.

3. The machine of claim 2, wherein said support surface and said means for blocking are shaped in such a way as to interact with central areas of faces of said at least one tile.

4. The machine of claim 2, wherein said at least one workpiece-bearing device and said means for blocking are arranged and shaped in such a way as to accommodate a stack of tiles on said support surface.

5. The machine of claim 4, comprising two of the workpiece-bearing devices arranged in opposite positions on a rotating platform; said rotating platform being able to rotate at least in such a way as to bring either of said two workpiece-bearing devices precisely into a position previously occupied by another of either of said two workpiece-bearing devices.

6. The machine of claim 4, comprising two drive heads, situated opposite one another and each bearing a grinding wheel arranged such as be able to operate on two opposite sides of said at least one tile.

7. The machine of claim 6, wherein said two drive heads are constrained to a mobile frame which is hinged to said fixed frame about a fixed axis.

8. The machine of claim 7, wherein said two drive heads are fixed to the mobile frame by means of adjustable couplings allowing for setting a desired distance between the grinding wheels mounted on the drive heads.

9. The machine of claim 7, wherein said fixed axis which is perpendicular to the index axis about which said at least one workpiece-bearing device can be rotated.

10. The machine of claim 7, wherein said grinding wheels are frontally-acting.

11. The machine of claim 10, wherein said grinding wheels mounted on said drive heads are positioned opposite in such a way as to give rise to two working areas which are parallel to the axis of rotation about which said at least one workpiece-bearing device can be angularly revolved by means of an indexing device.

12. The machine of claim 7, wherein said grinding wheels are peripherally-acting.

13. The machine of claim 12, wherein said grinding wheels mounted on said drive heads are positioned opposite in such a way as to give rise to two working areas which are parallel to the axis of rotation about which said at least one workpiece-bearing device can be angularly revolved by means of an indexing device.

14. The machine of claim 7, wherein said grinding wheels mounted on said drive heads are positioned opposite in such a way as to give rise to two working areas which are parallel to the axis of rotation about which said at least one workpiece-bearing device can be angularly revolved by means of an indexing device.

15. The machine of claim 1, wherein said at least one drive head is mounted on a mobile frame which is hinged to said fixed frame about a fixed axis.

16. A process for sizing and squaring slabs of materials such as glass, stone and marble, ceramic tiles and the like, comprising:

positioning and blocking of at least one tile on a workpiece-bearing device which can be revolved into various angular positions about an axis;

working of two opposite sides of said tile by means of rotating grinding wheels positioned opposite one another and operating on two planes situated at a predetermined distance;

said two planes being parallel to an axis of rotation of said workpiece-bearing device;

rotation of said workpiece-bearing device into a new predetermined angular position with respect to a previous position thereof and blocking thereof in said new predetermined angular position;

working of another two sides of said tile by means of the oppositely-positioned said grinding wheels.

17. The process of claim 16, wherein said workpiece-bearing device is rotated by 90°.

18. The process of claim 17, wherein an orderedly-piled stack consisting in a plurality of tiles can be positioned and blocked on said workpiece-bearing device.

19. A machine for simultaneously edge-finishing a plurality of workpiece slabs while the slabs are disposed in a stack, the machine comprising:

a fixed frame;

a support surface for supporting the stack of slabs thereon;

indexing means for rotating the support surface about an index axis generally perpendicular to the support surface, the indexing means including means for selectively holding the support surface at any one of a plurality of predetermined angles about the index axis;

clamping means for clamping the stack of slabs fixed onto the support surface during indexing rotation; and grinding means for grinding edges of slabs in the stack, the grinding means including means for moving a grinding wheel in a polygon side plane substantially perpendicular to the support surface, is substantially parallel to the index axis, and is held at a distance from the index axis during an edge-grinding operation; whereby each slab of the stack is simultaneously grindable to a same polygonal shape by alternatingly grinding the stack on the side plane and moving the support surface to a next one of the predetermined angles.

20. The machine according to claim 19, wherein the distance is constant and each of the predetermined angles is equal to a regular fraction of 360 degrees; whereby each slab in the stack is shaped as a regular polygon.

* * * * *